US009612044B2

(12) United States Patent
Bellis et al.

(10) Patent No.: US 9,612,044 B2
(45) Date of Patent: Apr. 4, 2017

(54) CRYOCOOLER HAVING VARIABLE-LENGTH INERTANCE CHANNEL FOR TUNING RESONANCE OF PULSE TUBE

(75) Inventors: Lowell A. Bellis, Long Beach, CA (US); Dominic R. Gooden, Redondo Beach, CA (US); Michael J. Ellis, Hawthorne, CA (US)

(73) Assignee: Raytheon Company, Waltham, MA (US)

( * ) Notice: Subject to any disclaimer, the term of this patent is extended or adjusted under 35 U.S.C. 154(b) by 439 days.

(21) Appl. No.: 13/615,136

(22) Filed: Sep. 13, 2012

(65) Prior Publication Data

US 2014/0069115 A1 Mar. 13, 2014

(51) Int. Cl.
*F25B 9/00* (2006.01)
*F25B 9/14* (2006.01)

(52) U.S. Cl.
CPC ..... *F25B 9/145* (2013.01); *F25B 2309/1411* (2013.01); *F25B 2309/1423* (2013.01)

(58) Field of Classification Search
CPC ..... F25B 2309/1423; F25B 2309/1411; F25B 9/145
USPC ..... 62/6
See application file for complete search history.

(56) References Cited

U.S. PATENT DOCUMENTS 5,613,365 A 3/1997 Mastrup et al.
5,966,943 A * 10/1999 Mitchell ..... F25B 9/145 60/520
6,184,757 B1 * 2/2001 Rosenthal ..... H01L 23/445 257/E23.096
9,091,463 B1 * 7/2015 Dodson ..... F25B 9/145
2007/0266714 A1 11/2007 Fiedler
2008/0072608 A1 * 3/2008 Rampersad ..... F25B 9/145 62/6
2008/0229760 A1 * 9/2008 Gedeon ..... F25B 9/145 62/6

(Continued)

FOREIGN PATENT DOCUMENTS

EP 0 319 594 6/1989
JP 2005-037015 2/2005

OTHER PUBLICATIONS

International Search Report dated Dec. 3, 2013 in connection with International Patent Application No. PCT/US2013/050513, 2 pages.

(Continued)

*Primary Examiner* — Frantz Jules
*Assistant Examiner* — Brian King

(57) ABSTRACT

A system includes a pulse tube, a compressor configured to create pulses of fluid in the pulse tube, and a surge tank. The surge tank includes a housing that defines a surge volume configured to receive the fluid from the pulse tube. An inertance channel defines a passageway through which the fluid flows to and from the surge volume. At least part of the inertance channel has an open side to the surge volume. The surge tank also includes an adjustable seal configured to block at least part of the open side of the inertance channel and to move in order to change a functional length of the inertance channel. The housing may include a material having a high coefficient of thermal expansion, and the adjustable seal may include a material having a low coefficient of thermal expansion.

21 Claims, 4 Drawing Sheets

(56) References Cited

U.S. PATENT DOCUMENTS

| | | | | |
|---|---|---|---|---|
| 2009/0084115 | A1 | 4/2009 | Yuan et al. | |
| 2009/0107150 | A1* | 4/2009 | Yuan | F25B 9/145 62/6 |
| 2010/0313577 | A1 | 12/2010 | Kirkconnell et al. | |
| 2011/0100023 | A1* | 5/2011 | Yuan et al. | 62/6 |
| 2012/0137719 | A1* | 6/2012 | Dong | F25B 39/02 62/340 |

OTHER PUBLICATIONS

Written Opinion of International Searching Authority dated Dec. 3, 2013 in connection with International Patent Application No. PCT/US2013/050513, 6 pages.

T. Nguyen, et al.; "Space Micro Pulse Tube Cooler"; Northrop Grumman Aerospace Systems, Redondo Beach, CA; International Cryocooler Conference, Inc. Bulder Co.; 2011; pp. 97-101.

J.M. Pfotenhauer, et al., "Continuously Variable Inertance Tubes for Pulse Tube Refrigerators", International Cryocooler Conference, Inc., 2011, p. 275-280.

C.S. Kirkconnell, et al., "Raytheon Stirling/PulseTube Cryocooler Maturation Programs", International Cryocooler Conference, Inc., 2009, p. 31-37.

Ray Radebaugh, "Pulse Tube Cryocoolers for Cooling Infrared Sensors", Proceedings of SPIE, The International Society for Optical Engineering, Infrared Technology and Application XXVI, vol. 4130, 2000, p. 363-379.

Ray Radebaugh, et al., "Inertance Tube Optimization for Pulse Tube Refrigerators", CP823, Advances in Cryogenic Engineering: Transactions of the Cryogenic Engineering Conference—CEC, vol. 51, 2006, p. 59-67.

Supplementary European Search Report dated Sep. 18, 2015 in connection with European Patent Application No. EP 13 83 8026.

* cited by examiner

CRYOCOOLER HAVING VARIABLE-LENGTH INERTANCE CHANNEL FOR TUNING RESONANCE OF PULSE TUBE

TECHNICAL FIELD

This disclosure is generally directed to cooling systems. More specifically, this disclosure is directed to a cryocooler having a variable-length inertance channel for tuning the resonance of a pulse tube.

BACKGROUND

Cryocoolers are often used to cool various devices or systems. One type of cryocooler includes a compressor that creates fluid flow into and out of a pulse tube. The pulse tube is typically connected to a surge volume, often by an inertance channel. During part of the thermodynamic cycle, fluid flows into the surge volume through the inertance channel. During another part of the thermodynamic cycle, fluid flows out of the surge volume through the inertance channel.

In order to optimize a cryocooler that uses a pulse tube, the inertance channel's length and diameter are typically designed so that the resonance frequency of the pulse tube matches the compressor's drive frequency. Often times, a resonant mode of a larger system that uses the cryocooler lies at a harmonic of the compressor's drive frequency, which can create problems. Because the behavior of a larger system may not be known or predicted accurately ahead of time, it is often inevitable that these problems arise. In some conventional systems, this is solved by retuning the pulse tube, which involves redesigning the cryocooler's surge volume and inertance channel. However, this often results in increased costs and delays.

SUMMARY

This disclosure provides a cryocooler having a variable-length inertance channel for tuning the resonance of a pulse tube.

In a first embodiment, an apparatus includes a surge tank having a housing that defines a surge volume configured to receive fluid from a cryocooler. The apparatus also includes an inertance channel defining a passageway through which the fluid flows to and from the surge volume, where at least part of the inertance channel has an open side to the surge volume. The apparatus further includes an adjustable seal configured to block at least part of the open side of the inertance channel and to move in order to change a functional length of the inertance channel.

In a second embodiment, a system includes a pulse tube, a compressor configured to create pulses of fluid in the pulse tube, and a surge tank. The surge tank includes a housing that defines a surge volume configured to receive the fluid from the pulse tube. An inertance channel defines a passageway through which the fluid flows to and from the surge volume. At least part of the inertance channel has an open side to the surge volume. The surge tank also includes an adjustable seal configured to block at least part of the open side of the inertance channel and to move in order to change a functional length of the inertance channel.

In a third embodiment, a method includes identifying a desired resonance frequency of a pulse tube in a cooling system. The desired resonance frequency is associated with a drive frequency of a compressor in the cooling system. The method also includes identifying a desired length of an inertance channel in the cooling system. The inertance channel fluidly couples the pulse tube and a surge volume in a surge tank. At least part of the inertance channel has an open side to the surge volume. The method further includes adjusting a position of an adjustable seal in the surge tank based on the desired length of the inertance channel. The adjustable seal is configured to block at least part of the open side of the inertance channel and to move in order to change a functional length of the inertance channel.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 5, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged pulse tube device or system, including (but not limited to) a single-stage pulse tube cryocooler, a two-stage pulse tube cryocooler, a two-stage Stirling/pulse tube hybrid cryocooler, or a three-stage cryocooler having a Stirling first stage and pulse tube second and third stages.

Figure 1:
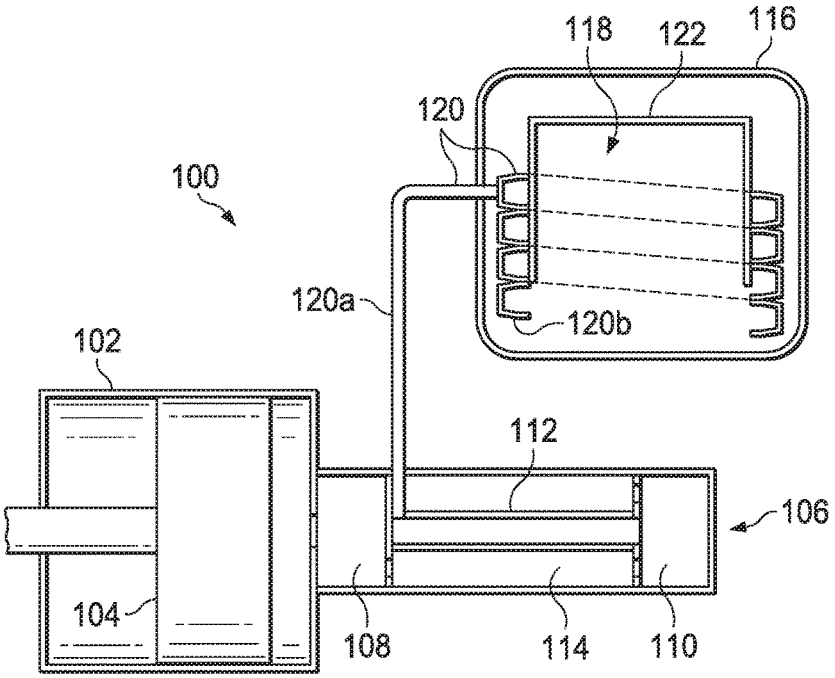
FIG. 1 illustrates an example pulse tube cryocooler having a variable-length inertance channel for tuning the resonance of a pulse tube in accordance with this disclosure.

FIG. 1 illustrates an example pulse tube cryocooler 100 having a variable-length inertance channel for tuning the resonance of a pulse tube in accordance with this disclosure. As shown in FIG. 1, the cryocooler 100 here represents a single-stage pulse tube cryocooler. In this embodiment, the cryocooler 100 includes a compressor 102 having a piston 104. The piston 104 strokes back and forth during each compression cycle, and multiple compression cycles occur at a specified drive frequency. The compressor 102 includes any suitable structure for compressing at least one gas or other fluid(s) used in a cooling system. The piston 104 includes any suitable structure configured to repeatedly move back and forth in order to compress at least one fluid during multiple compression cycles.

A cold head 106 is in fluid communication with the compressor 102. As the piston 104 moves to the right in FIG. 1, fluid is pushed into the cold head 106, increasing the pressure within the cold head 106. As the piston 104 moves to the left in FIG. 1, fluid can exit the cold head 106, decreasing the pressure within the cold head 106. This back and forth motion of the fluid, along with controlled expansion and contraction of the fluid, creates cooling in the cold head 106. In this example, the fluid passes between a warm end 108 and a cold end 110. As the names imply, the warm end 108 is at a higher temperature than the cold end 110. The cold head 106 can therefore, for example, be thermally coupled to a device or system to be cooled.

The cryocooler 100 also includes a pulse tube 112 and a regenerator 114. The regenerator 114 represents a structure that contacts the fluid and exchanges heat with the fluid. For example, when the fluid passes from the warm end 108 to the cold end 110, heat from the fluid is absorbed by the regenerator 114 during half of the thermodynamic cycle. When the fluid passes from the cold end 110 to the warm end 108, heat from the regenerator 114 is absorbed by the fluid during the other half of the thermodynamic cycle.

The cold head 106 includes any suitable structure for coupling to an external device or system to be cooled. The pulse tube 112 represents any suitable structure through which fluid can flow. The regenerator 114 includes any suitable structure for transferring heat to and from fluid. The regenerator 114 could, for example, represent a porous structure (such as a matrix of porous material or a metallic mesh) with a hole bored through the structure. The entire structure could be formed from any suitable material(s), have any suitable size, shape, and dimensions, and be fabricated in any suitable manner.

The pulse tube 112 is fluidly coupled to a surge tank 116. The surge tank 116 defines a surge volume 118 that can store the fluid. An inertance channel 120 defines a path through which the fluid in the pulse tube 112 can flow to reach the surge volume 118. In this example, the inertance channel 120 includes a fixed-length portion 120*a* and a variable-length portion 120*b*. The fixed-length portion 120*a* represents any suitable structure supporting fluid flow, such as a small metal or other tubing. The variable-length portion 120*b* represents an adjustable portion of the inertance channel 120 described in more detail below. Note that the use of the fixed-length portion 120*a* of the inertance channel 120 is optional. The surge tank 116 represents any suitable structure configured to receive and retain fluid within a defined volume. The surge tank 116 is typically sealed against the ambient environment to prevent venting of the fluid.

In this example, the variable-length portion 120*b* of the inertance channel 120 is integrally formed within the surge tank 116. The variable-length portion 120*b* is formed in the inner wall of the surge tank 116 and has an open side to the surge volume 118, meaning the open side provides access to the surge volume 118. For example, the surge volume 118 could represent a cylindrical space within the surge tank 116, and a spiral portion 120*b* of the inertance channel 120 could be formed within the inner wall of the surge tank 116. Note that the surge volume 118 could have any other suitable shape, and the variable-length portion 120*b* of the inertance channel 120 could have any other suitable pattern.

The inertance channel 120 represents a passageway through which fluid flows between the pulse tube 112 and the surge volume 118. When fluid flows into the inertance channel 120 from the pulse tube 112, the fluid can follow the channel 120 until it eventually reaches the surge volume 118. Similarly, when fluid flows into the inertance channel 120 from the surge volume 118, the fluid can follow the channel 120 until it eventually reaches the pulse tube 112. As noted above, the length and diameter of an inertance channel is typically designed so that the resonance frequency of a pulse tube matches the drive frequency of a compressor. If a device or system incorporating the cryocooler 100 has a resonant mode that lies at a harmonic of the compressor's drive frequency, this can create problems. Moreover, changing the length or diameter of an inertance channel can be time consuming and expensive.

In accordance with this disclosure, the functional length of the inertance channel 120 can be altered using an adjustable seal 122. The "functional length" represents the portion of the inertance channel 120 that fluid travels through before reaching an outlet. The seal 122 is depressed against the inner wall of the surge tank 116, thereby blocking the open side of the portion 120*b*. The seal 122 therefore helps to prevent fluid in at least part of the inertance channel 120 (namely in the variable-length portion 120*b*) from escaping the channel 120 until the fluid reaches a desired outlet point. However, the seal 122 here is adjustable, meaning the seal 122 can be moved to change the location of the channel's outlet. For instance, in the example shown in FIG. 1, the seal 122 could be moved up and down. When at its lowest position in FIG. 1, fluid from the pulse tube 112 may flow through substantially the entire length of the channel 120 before exiting into the surge volume 118. When the seal 122 is raised upward, fluid from the pulse tube 112 may exit the channel 120 sooner since the seal 122 no longer covers the open side along the entire length of the channel 120. Instead, the open side of part of the channel 120 becomes exposed, so the fluid can exit the channel earlier, thereby effectively shortening the functional length of the inertance channel 120.

The seal 122 represents any suitable structure for sealing an open portion of an inertance channel. The seal 122 could, for example, represent a cylindrical sealing can. Any suitable type of seal 122 could be used here. For example, in some embodiments, a housing of the surge tank 116 is formed from material(s) having a high coefficient of thermal expansion (CTE), while the seal 122 is formed from material(s) having a low coefficient of thermal expansion. When the cryocooler 100 is warm (such as above ambient temperature), the seal 122 can be moved into a desired position. When the cryocooler 100 is cooled to at least a threshold temperature (such as room temperature), the different coefficients of thermal expansion cause the seal 122 to block the open side of at least part of the channel 120. To change the length of the inertance channel 120, the cryocooler 100 is warmed up again (such as above ambient temperature), and the seal 122 is moved up to shorten the inertance channel 120 or down to lengthen the inertance channel 120. In these embodiments, the position of the seal 122 can be adjusted without venting the fluid within the cryocooler 100 and while the cryocooler 100 is fully integrated into a larger device or system. The seal 122 could be moved manually (such as by rotating one or more knobs) or automatically (such as with a motor-driven actuator). If driven by a motor, the adjustment could be performed remotely.

In this way, the length of the inertance channel 120 is adjustable by altering the position of the seal 122. This allows the operating frequency of the cryocooler 100 to be adjusted without requiring a redesign of the cryocooler's surge volume and inertance channel. For example, when the resonant mode of a larger system lies at a harmonic of the compressor's drive frequency, the compressor's drive frequency can be altered, and the seal 122 can be adjusted to alter the resonance frequency of the pulse tube 112 to match the compressor's new drive frequency. This can be done quickly without venting the cooling fluid and without changing the structural design of the cryocooler 100. Moreover, the seal 122 can be said to have "infinite variability," meaning the seal 122 could be placed in any position between its extreme positions and is not limited to a specified step size between positions. This allows fine adjustments to the resonance frequency of the pulse tube 112.

Note that the use of different coefficients of thermal expansion represents one way that the seal 122 can block the open side of the inertance channel 120. Any other suitable technique could also be used. For instance, the seal 122 could be mechanically wedged up against the inner wall of the surge tank 116 to block the open side of the channel 120. This disclosure is not limited to any particular sealing technique.

Although FIG. 1 illustrates one example of a pulse tube cryocooler 100 having a variable-length inertance channel for tuning the resonance of a pulse tube, various changes may be made to FIG. 1. For example, the illustrated size and shape of each component and the relative sizes and shapes of multiple components are for illustration only. Components in the cryocooler 100 can have any suitable size and shape. Also, the layout and arrangement of the components are for illustration only. The components in the cryocooler 100 could have any other suitable layout and arrangement. In addition, the use of the fixed-length portion 120*a* of the inertance channel 120 is optional, and other connecting mechanisms could be used to fluidly couple a pulse tube and a variable-length inertance channel.

Figure 2:
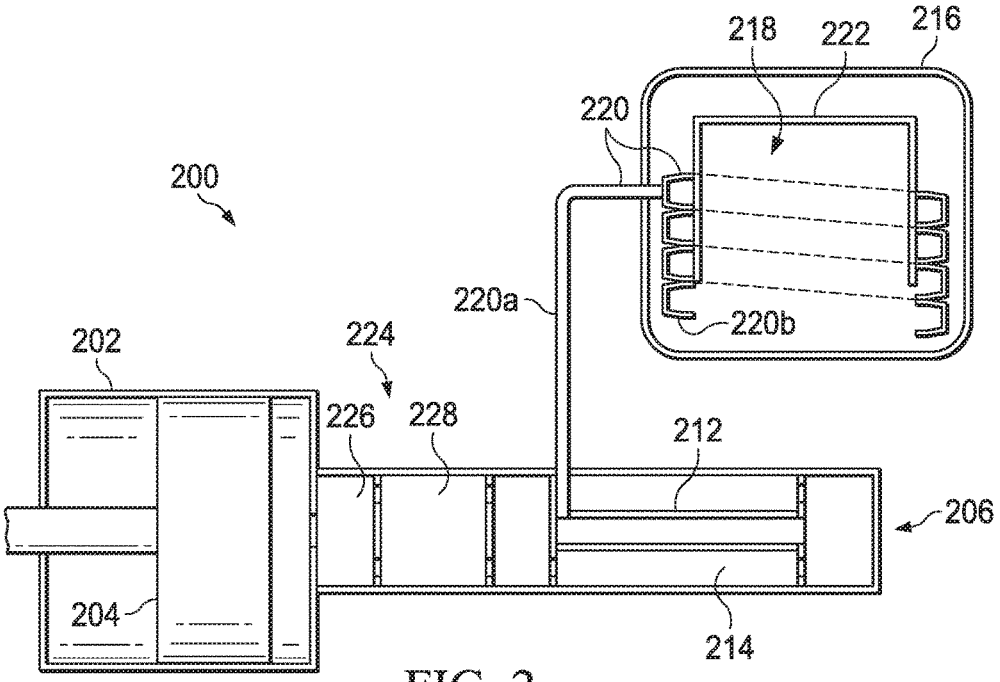
FIG. 2 illustrates an example Stirling/pulse tube cryocooler having a variable-length inertance channel for tuning the resonance of a pulse tube in accordance with this disclosure.

FIG. 2 illustrates an example Stirling/pulse tube cryocooler 200 having a variable-length inertance channel for tuning the resonance of a pulse tube in accordance with this disclosure. As shown in FIG. 2, the cryocooler 200 here represents a two-stage Stirling-cycle pulse tube cryocooler. In this embodiment, the cryocooler 200 includes a compressor 202 having a piston 204. The cryocooler 200 also includes a cold head 206, a pulse tube 212, and a regenerator 214. The pulse tube 212 is fluidly coupled to a surge tank 216, which defines a surge volume 218, by an inertance channel 220. The inertance channel 220 here includes a fixed-length portion 220*a* and a variable-length portion 220*b*. The variable-length portion 220*b* of the inertance channel 220 is integrally formed within the surge tank 216, such as along the inner wall of the surge tank 216. An adjustable seal 222 can be used to alter the functional length of the inertance channel 220. The components 202-222 shown here can be the same as or similar to the corresponding components 102-122 in FIG. 1.

In this example, the pulse tube 212 is used in the second stage of the cryocooler 200. The first stage of the cryocooler 200 is formed by a Stirling cooler 224 that includes a passage 226 and a regenerator 228. The first stage operates to cool the fluid before the fluid reaches the second stage, and the second stage operates to cool the fluid even more. Here, the compressor 202 provides the fluid to the passage 226, causing the fluid to move back and forth within the passage 226 and the pulse tube 212. When the fluid passes from the compressor 202 to the cold head 206, heat from the fluid is absorbed by the regenerators 228 and 214. When the fluid passes from the cold head 206 to the compressor 202, heat from the regenerators 228 and 214 is absorbed by the fluid.

The first stage of the cryocooler 200 includes any suitable structure for holding a fluid that moves back and forth during multiple cycles. The first stage of the cryocooler 200 could be formed from any suitable material(s), have any suitable size, shape, and dimensions, and be fabricated in any suitable manner. The regenerator 228 includes any suitable porous structure for transferring heat to and from at least one fluid in a tube. The regenerator 228 could, for example, represent a matrix of porous material or a metallic mesh.

As with the cryocooler 100, the operation of the cryocooler 200 can be altered using the adjustable seal 222 to change the functional length of the inertance channel 220. When the seal 222 is at its lowest position, fluid from the pulse tube 212 may flow through the entire length of the channel 220 before exiting into the surge volume 218. When the seal 222 is raised upward, fluid from the pulse tube 212 may exit the channel 220 sooner since the seal 222 no longer covers the open side along the entire length of the channel 220. Instead, the open side of part of the channel 220 becomes exposed, so the fluid can exit the channel earlier, thereby effectively shortening the functional length of the inertance channel 220.

Note that any suitable type of sealing mechanism could be used here, such as different coefficients of thermal expansion or mechanical wedges. If different CTEs are used, when the cryocooler 200 is warm (such as at ambient temperature), the seal 222 can be moved into a desired position. When the cryocooler 200 is cooled to at least a threshold temperature (such as sub-ambient temperature), the different coefficients of thermal expansion cause the seal 222 to block the open side of at least part of the channel 220. To change the length of the inertance channel 220, the cryocooler 200 is warmed up again (such as to ambient temperature), and the seal 222 is moved up to shorten the inertance channel 220 or down to lengthen the inertance channel 220. Again, the position of the seal 222 can be adjusted without venting the fluid within the cryocooler 200 and while the cryocooler 200 is fully integrated into a larger device or system, and the seal 222 could be moved manually or automatically.

Also note that the surge volumes and inertance channels are used at different temperatures in FIGS. 1 and 2. In FIG. 1, the surge volume 118 receives fluid from the warm end, so the fluid in the surge volume 118 is closer to ambient temperature. In FIG. 2, the surge volume 218 receives fluid that has already been cooled by the Stirling cooler 224, so the fluid in the surge volume 218 can be at sub-ambient, possibly even cryogenic, temperatures.

Although FIG. 2 illustrates one example of a Stirling/pulse tube cryocooler having a variable-length inertance channel for tuning the resonance of a pulse tube, various changes may be made to FIG. 2. For example, the illustrated size and shape of each component and the relative sizes and shapes of multiple components are for illustration only. Components in the cryocooler 200 can have any suitable size and shape. Also, the layout and arrangement of the components are for illustration only. The components in the cryocooler 200 could have any other suitable layout and arrangement. Further, the use of the fixed-length portion 220*a* of the inertance channel 220 is optional, and other connecting mechanisms could be used to fluidly couple a pulse tube and a variable-length inertance channel. In addition, a variable-length inertance channel could be used in a cooling system with any suitable number and types of stages. For instance, a variable-length inertance channel could be used in a single-stage pulse tube cryocooler, a two-stage pulse tube cryocooler, a two-stage Stirling/pulse tube hybrid cryocooler, or a three-stage cryocooler having a Stirling first stage and pulse tube second and third stages.

Figure 3A:
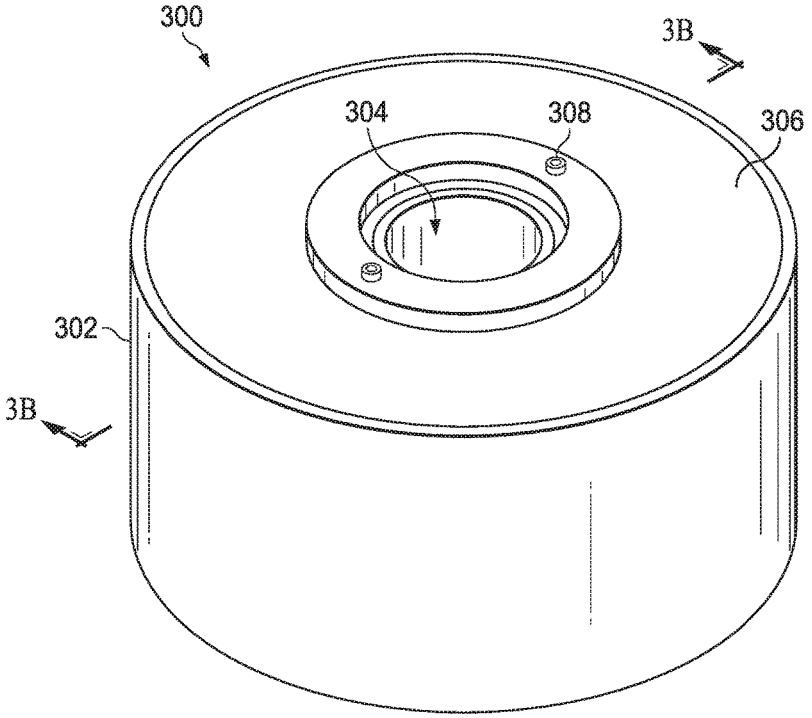
FIGS. 3A and 3B illustrate an example surge tank of a cryocooler having a variable-length inertance channel for tuning the resonance of a pulse tube in accordance with this disclosure.
Figure 3B:
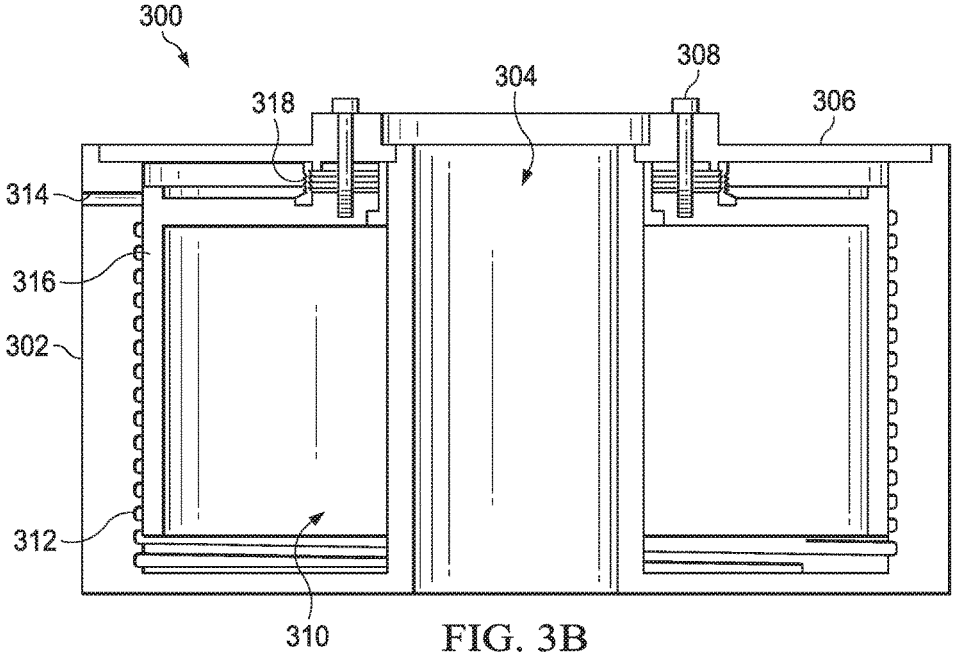

FIGS. 3A and 3B illustrate an example surge tank 300 of a cryocooler having a variable-length inertance channel for tuning the resonance of a pulse tube in accordance with this disclosure. This embodiment of the surge tank 300 is for illustration only. Other surge tanks could be used in the cryocoolers described above, and the surge tank 300 could be used in other cryocoolers.

As shown in FIGS. 3A and 3B, the surge tank 300 here includes a generally cylindrical housing 302 with a hollow central section 304. The hollow central section 304 could, for example, allow part of a pulse tube to fit through the surge tank 300. This can help to reduce the space needed for a cryocooler, although surge tanks having housings with other shapes could also be used. The housing 302 includes any suitable structure for forming a surge volume for a cryocooler. The housing 302 could also be formed from any suitable material(s) and in any suitable manner.

The surge tank 300 also includes a lid 306, which is sealed to the housing 302. The lid 306 can be secured to the housing 302 after cooling fluid and other components have been placed within an interior space of the housing 302. The lid 306 could have any suitable size and shape depending on the size and shape of the housing 302. The lid 306 could also be formed from any suitable material(s) and in any suitable manner. One or more adjusters 308 could be used to adjust the functional length of an inertance channel as described below. Each adjuster 308 includes any suitable structure for adjusting an inertance channel.

As shown in FIG. 3B, the housing 302 defines a surge volume 310 into which fluid associated with a pulse tube can enter and exit. The surge volume 310 could have any suitable volume and three-dimensional shape depending on the implementation. The housing 302 also has an integral inertance channel 312 defined along the inner wall of the housing 302, as well as an inlet 314 to the inertance channel 312. The inertance channel 312 could have any suitable size, shape, and pattern. In particular embodiments, the inertance channel 312 represents a rectangular-shaped spiral channel, similar to an internal thread with rounded corners. Also, the inertance channel 312 could represent the entire length of an inertance channel or only a portion of the total length of the inertance channel.

An adjustable seal 316 resides within the surge volume 310, and the adjustable seal 316 seals the open side of at least part of the inertance channel 312. The seal 316 can also be raised and lowered within the surge volume 310 using the adjusters 308. For example, the adjusters 308 could be threaded and engage with threaded recesses of the seal 316. The seal 316 represents any suitable structure for sealing an open side of an inertance channel, such as a sealing can. Any suitable technique could be used to seal an inertance channel using the seal 316, such as different coefficients of thermal expansion or a mechanical wedge. When different coefficients of thermal expansion are used, the housing 302 could be formed from stainless steel or aluminum, while the adjustable seal 316 could be formed from $FeNi_{36}$ (sold under the name INVAR).

Flexible seals 318 between the lid 306 and the adjustable seal 316 prevent fluid from escaping from the surge volume 310 through openings in the lid 306 where the adjusters 308 are located. The seals 318 are flexible to provide this protection even as the position of the adjustable seal 316 is altered. Each flexible seal 318 includes any suitable seal for preventing leakage of fluid.

The surge tank 300 can operate as described above. For example, when different coefficients of thermal expansion are used, the adjusters 308 could be used to position the seal 316 when a cryocooler is at or above ambient temperature. When the cryocooler is placed into operation or is otherwise cooled, the lower temperature causes the seal 316 to block the open side of at least part of the channel 312, thereby sealing the inertance channel 312 and giving the channel 312 a specified length. If needed, the temperature of the cryocooler can be increased, the adjusters 308 can be used to reposition the seal 316, and the cryocooler can be placed back into operation. In this way, the length of the inertance channel 312 can be adjusted to tune the resonance of a pulse tube.

Although FIGS. 3A and 3B illustrate one example of a surge tank 300 of a cryocooler having a variable-length inertance channel for tuning the resonance of a pulse tube, various changes may be made to FIGS. 3A and 3B. For example, as noted above, the size, shape, and dimensions of the various components in the surge tank 300 could be altered according to particular needs. Also, any other suitable technique could be used for altering the position of the seal 316 within the surge volume 310.

Figure 4B:
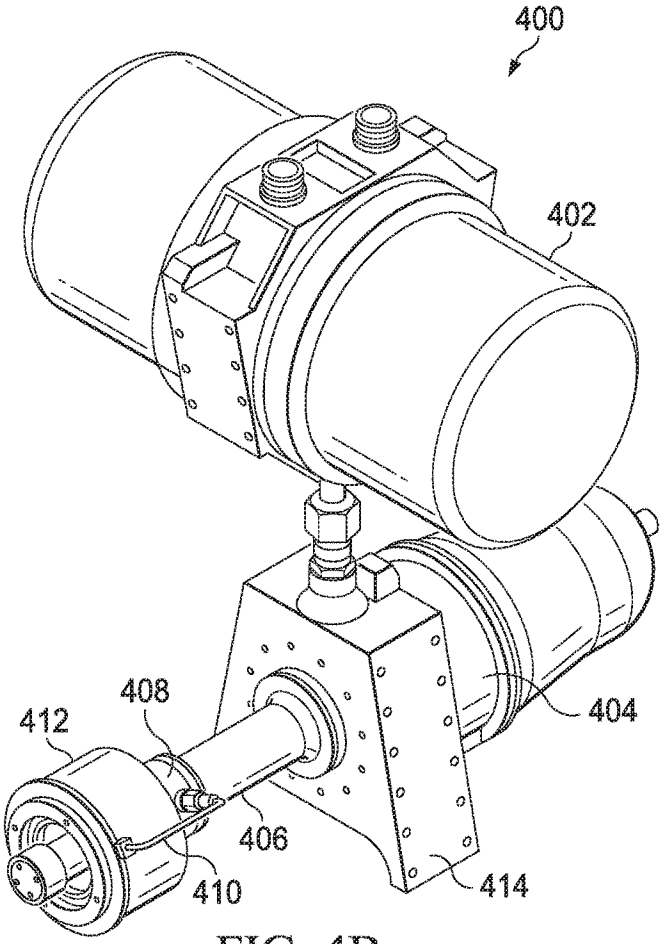
FIGS. 4A and 4B illustrate an example system containing a cryocooler having a variable-length inertance channel for tuning the resonance of a pulse tube in accordance with this disclosure.
Figure 4A:
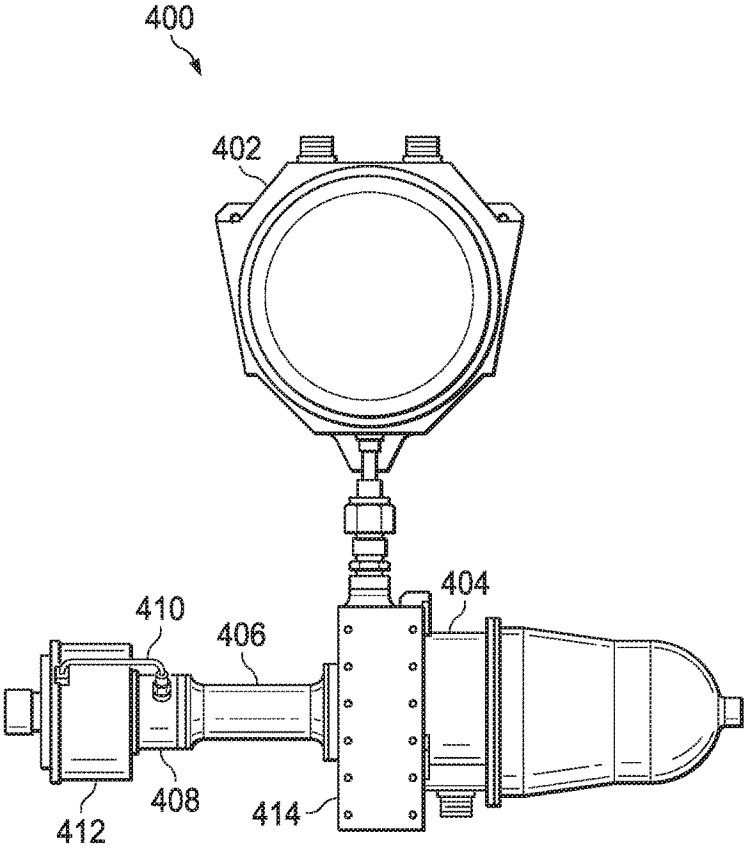

FIGS. 4A and 4B illustrate an example system 400 containing a cryocooler having a variable-length inertance channel for tuning the resonance of a pulse tube in accordance with this disclosure. As shown in FIGS. 4A and 4B, a compressor 402 is fluidly coupled to an expander 404. The form of the compressor 402 shown here is for illustration only, and any suitable compressor could be used in the system 400. The expander 404 represents part of a first stage 406 of a two-stage cooling system. A second stage 408 of the cooling system includes a pulse tube.

A fixed-length portion 410 of an inertance channel couples the pulse tube to the inlet of a surge tank 412. The surge tank 412 has the structure shown in FIGS. 3A and 3B. As shown here, part of the pulse tube fits within the hollow central section of the surge tank 412, which can help to reduce the size of the overall system 400. The system 400 also includes a heat rejection mechanism 414, which transfers heat out of the system 400.

The surge tank 412 includes a variable-length portion of the inertance channel such as those described above. Once the system 400 is placed into operation, the surge tank 412 can be adjusted (such as via the adjusters 308) to alter the length of the inertance channel in the surge tank 412. In this way, the length of the inertance channel can be adjusted to tune the resonance frequency of the pulse tube to the frequency of the compressor 402 and, if necessary, readjusted to tune the resonance frequency of the pulse tube to a new frequency of the compressor 402.

Although FIGS. 4A and 4B illustrate one example of a system 400 containing a cryocooler having a variable-length inertance channel for tuning the resonance of a pulse tube, various changes may be made to FIGS. 4A and 4B. For example, the form factor of each component shown here is for illustration only. Also, a variable-length inertance channel could be used with a singe-stage cooling system or a cooling system with more than two stages.

Figure 5:
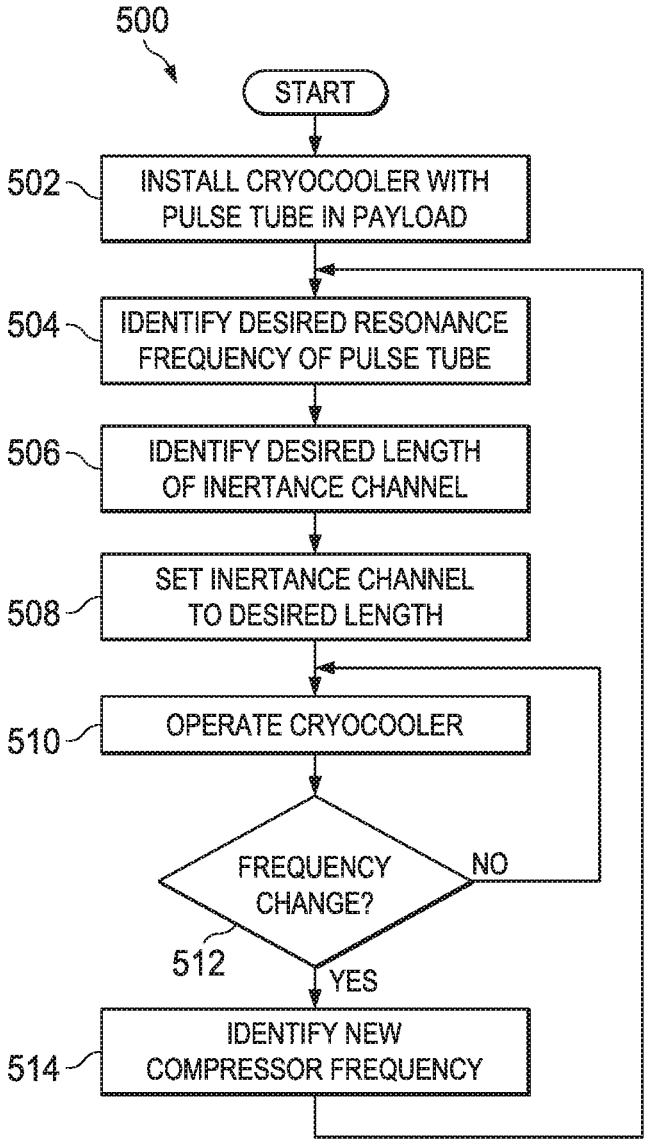
FIG. 5 illustrates an example method for providing cooling in a system using a cryocooler having a variable-length inertance channel for tuning the resonance of a pulse tube in accordance with this disclosure.

FIG. 5 illustrates an example method 500 for providing cooling in a system using a cryocooler having a variable-length inertance channel for tuning the resonance of a pulse tube in accordance with this disclosure. As shown in FIG. 5, a cryocooler with a pulse tube is installed in a payload at step 502. The payload could represent any larger device or system desiring or requiring cooling by the cryocooler. Example payloads could include focal plane arrays, optical benches, or superconductive devices that need cooling.

A desired resonance frequency of the pulse tube in the cryocooler is identified at step 504. This could include, for example, identifying the drive frequency of a compressor in the cryocooler. The desired resonance frequency of the pulse tube could equal the drive frequency of the compressor. The desired length of an inertance channel in the cryocooler is identified at step 506. This could include, for example, using the desired resonance frequency w of the pulse tube to identify the length of the inertance channel needed to obtain that resonance frequency. The desired length of the inertance channel could be determined using simulations or any other suitable manner. The resonance frequency of an inertance channel represents the frequency where its impedance is at a minimum. The complex impedance of an inertance channel with length L can be given by:

$$Z_m(D, x) = Z_0(D)\left[\frac{Z_r + Z_0(D)\tanh[k(D)(L-x)]}{Z_0(D) + Z_r\tanh[k(D)(L-x)]}\right],$$

where:

$$Z_r = 1/(i\omega C_r).$$

$$C_r = V_r/(\gamma R T_r).$$

$$Z_0(D) = \sqrt{\frac{r(D) + i\omega l(D)}{i\omega c(D)}},$$

$$\text{(resistance/length) } r(D) = (2/\pi)\left[\frac{32 f_r |\dot{m}|}{\pi^2 \rho_0 D^5}\right],$$

$$\text{(inertance/length) } l(D) = 4/(\pi D^2),$$

$$\text{(compliance/length) } c(D) = (\pi D^2)/(4\gamma R T_0),$$

$$k(D) = \sqrt{[r(D) + i\omega l(D)]i\omega c(D)}.$$

These calculations are described in Radebaugh et al., "Inertance Tube Optimization for Pulse Tube Refrigerators," Advances in Cryogenic Engineering: Transactions of the Cryogenic Engineering Conference—CEC, Vol. 51, 2006 (which is hereby incorporated by reference).

The inertance channel in the cryocooler is set to the desired length at step 508. This could include, for example, altering the position of an adjustable seal within the surge tank of the cryocooler. As a particular example, this could include using the adjusters 308 to raise the seal in order to shorten the inertance channel or using the adjusters 308 to lower the seal in order to lengthen the inertance channel.

The cryocooler is placed into operation at step 510. This could include, for example, operating the compressor of the cryocooler at a specified drive frequency. Ideally, the length of the inertance channel causes the pulse tube in the cryocooler to have a resonance frequency that at least substantially matches the drive frequency of the compressor. In particular embodiments, the inertance channel in the cryocooler is set to the desired length at ambient temperature, placing the cryocooler into operation causes the adjustable seal in the surge tank to fall in temperature, and different materials having different coefficients of thermal expansion seal open sides of the inertance channel at the lower temperature. In other particular embodiments, the inertance channel in the cryocooler is set to the desired length at above-ambient temperature, the cryocooler cooling to ambient temperature causes the adjustable seal in the surge tank to fall in temperature, and different materials having different coefficients of thermal expansion seal open sides of the inertance channel at the lower temperature. In other embodiments, the inertance channel in the cryocooler is set by warming up the adjustable inertance channel. Having a larger CTE housing and a lower or negative CTE adjustable seal causes the housing to expand more than the adjustable seal, disconnecting them to allow for adjustment. The temperature at which this occurs can depend on the device's dimensions and the CTE difference.

A determination is made whether a frequency change of the compressor is needed at step 512. A frequency change may be needed for various reasons. As described above, one reason may be to change the compressor's drive frequency so that a resonant mode of the payload is not at a harmonic of the compressor's drive frequency. If no frequency change is needed, the cryocooler can continue operating at step 510. If a change in frequency is needed, a new drive frequency of the compressor is identified at step 514. The process then returns to step 504, where the length of the inertance channel can be changed to tune the resonance frequency of the pulse tube to the new drive frequency of the compressor. In particular embodiments, the length of the inertance channel in the cryocooler is changed at ambient temperature, and the surge volume within the cryocooler is not opened to the ambient environment (meaning there is no venting of the fluid even when the length of the inertance channel is changed).

Although FIG. 5 illustrates one example of a method 500 for providing cooling in a system using a cryocooler having a variable-length inertance channel for tuning the resonance of a pulse tube, various changes may be made to FIG. 5. For example, while shown as a series of steps, various steps in FIG. 5 could overlap, occur in parallel, occur in a different order, or occur any number of times.

Note that in the above descriptions, it has been assumed that an inertance channel is integrally formed within the inner wall of a surge tank. However, other embodiments could also be used. For example, tubing with an open side could be placed along the inner wall of a surge tank, and an adjustable seal could be used to seal at least part of the open side of the tubing. Also note that an inertance channel could have an open side along its entire length or along only part of its length, such as a small part of its length near the end of the inertance channel.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. Directional terms such as "raise," "lower," "up," and "down" refer to directions within the figures and do not require any particular directional arrangement of components or directional use of a device.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a surge tank comprising a housing that defines a surge volume configured to receive fluid from a cryocooler;

an inertance channel defining a passageway through which the fluid flows to and from the surge volume, at least part of the inertance channel comprising a channel in an inner wall of the housing, the channel in the inner wall having an open side to the surge volume along at least part of a length of the channel in the inner wall; and an adjustable seal positioned at least partially along the inner wall within the surge tank, the adjustable seal configured to block at least part of the open side of the channel in the inner wall, the adjustable seal also configured to move along an axis of the surge tank in order to change a functional length of the inertance channel by changing a location of an outlet of the inertance channel into the surge volume.

2. The apparatus of claim 1, wherein the surge tank further comprises:

a lid covering an interior space defined by the housing, the adjustable seal located within the interior space; and an adjuster through the lid, the adjuster configured to change a position of the adjustable seal.

3. The apparatus of claim 2, wherein:

the lid is sealed to the housing; and the adjuster is configured to change the position of the adjustable seal without venting the interior space.

4. The apparatus of claim 2, further comprising:

a flexible seal between the lid and the adjustable seal, the flexible seal configured to prevent leakage of fluid through an opening in the lid, the adjuster passing through the opening in the lid.

5. The apparatus of claim 1, wherein:

the housing comprises a material having a first coefficient of thermal expansion; and the adjustable seal comprises a material having a second coefficient of thermal expansion, the first coefficient of thermal expansion higher than the second coefficient of thermal expansion.

6. The apparatus of claim 1, wherein:

the surge volume comprises a cylindrical space; and the channel in the inner wall of the housing comprises a spiral channel around the cylindrical space.

7. The apparatus of claim 1, wherein:

the housing is cylindrical with a hollow central region configured to receive part of a pulse tube; and the adjustable seal comprises a sealing can.

8. A system comprising:

a pulse tube;

a compressor configured to create pulses of fluid in the pulse tube;

a surge tank comprising a housing that defines a surge volume configured to receive the fluid from the pulse tube; and an inertance channel defining a passageway through which the fluid flows to and from the surge volume, at least part of the inertance channel comprising a channel in an inner wall of the housing, the channel in the inner wall having an open side to the surge volume along at least part of a length of the channel in the inner wall;

wherein the surge tank comprises an adjustable seal positioned at least partially along the inner wall within the surge tank, the adjustable seal configured to block at least part of the open side of the channel in the inner wall, the adjustable seal also configured to move along an axis of the surge tank in order to change a functional length of the inertance channel by changing a location of an outlet of the inertance channel into the surge volume.

9. The system of claim 8, wherein the pulse tube comprises one stage of a multi-stage cooling system.

10. The system of claim 8, wherein the surge tank further comprises:

a lid covering an interior space defined by the housing, the adjustable seal located within the interior space; and an adjuster through the lid, the adjuster configured to change a position of the adjustable seal.

11. The system of claim 10, wherein:

the lid is sealed to the housing; and the adjuster is configured to change the position of the adjustable seal without venting the interior space.

12. The system of claim 10, wherein the surge tank further comprises:

a flexible seal between the lid and the adjustable seal, the flexible seal configured to prevent leakage of fluid through an opening in the lid, the adjuster passing through the opening in the lid.

13. The system of claim 8, wherein:

the housing comprises a material having a first coefficient of thermal expansion; and the adjustable seal comprises a material having a second coefficient of thermal expansion, the first coefficient of thermal expansion higher than the second coefficient of thermal expansion.

14. The system of claim 8, wherein:

the surge volume comprises a cylindrical space; and the channel in the inner wall of the housing comprises a spiral channel around the cylindrical space.

15. The system of claim 8, wherein the inertance channel comprises:

a first portion having a fixed functional length; and a second portion having a variable functional length.

16. The system of claim 8, wherein:

the housing is cylindrical with a hollow central region configured to receive part of the pulse tube; and the adjustable seal comprises a sealing can.

17. A method comprising:

identifying a desired resonance frequency of a pulse tube in a cooling system, the desired resonance frequency associated with a drive frequency of a compressor in the cooling system;

identifying a desired length of an inertance channel in the cooling system, the inertance channel fluidly coupling the pulse tube and a surge volume in a surge tank, the surge tank comprising a housing that defines the surge volume, the surge volume configured to receive fluid from the cooling system, the inertance channel defining a passageway through which the fluid flows to and from the surge volume, at least part of the inertance channel comprising a channel in an inner wall of the housing, the channel in the inner wall having an open side to the surge volume along at least part of a length of the channel in the inner wall; and adjusting a position of an adjustable seal within the surge tank based on the desired length of the inertance channel, the adjustable seal positioned at least partially along the inner wall and configured to block at least part of the open side of the channel in the inner wall, the adjustable seal also configured to move along an axis of the surge tank in order to change a functional length of the inertance channel by changing a location of an outlet of the inertance channel into the surge volume.

18. The method of claim 17, wherein:

the housing comprises a material having a first coefficient of thermal expansion;

the adjustable seal comprises a material having a second coefficient of thermal expansion such that, when the surge tank is cooled, the adjustable seal blocks the at least part of the open side of the channel in the inner wall; and the first coefficient of thermal expansion is higher than the second coefficient of thermal expansion.

19. The method of claim 17, further comprising:

readjusting the position of the adjustable seal in the surge tank in order to alter a resonance frequency of the pulse tube.

20. The apparatus of claim 1, wherein the channel in the inner wall of the housing has the open side to the surge volume along substantially an entire length of the channel in the inner wall.

21. The apparatus of claim 1, wherein the inertance channel is at least partially enclosed by the inner wall of the housing.

* * * * *